United States Patent [19]

Spenceley et al.

[11] 4,430,117

[45] Feb. 7, 1984

[54] PRODUCTION OF STEEL

[75] Inventors: Gene D. Spenceley, Stokesley; Mervyn W. Davies, Near Yarm; Alan L. Robson, Middlesbrough, all of England

[73] Assignee: British Steel Corporation, England

[21] Appl. No.: 437,503

[22] Filed: Oct. 28, 1982

[30] Foreign Application Priority Data

Oct. 30, 1981 [GB] United Kingdom ..... 8132732

[51] Int. Cl.[3] ..... C21C 5/32; C21C 5/34

[52] U.S. Cl. ..... 75/51

[58] Field of Search ..... 75/51, 52, 59, 60

[56] References Cited

U.S. PATENT DOCUMENTS

| | | | |
|---|---|---|---|
| 2,991,173 | 7/1961 | Trentini | 75/52 |
| 3,854,932 | 12/1974 | Bishop | 75/60 |
| 4,045,213 | 8/1977 | Leroy | 75/51 |
| 4,089,677 | 5/1978 | Spenceley | 75/60 |
| 4,178,173 | 11/1979 | Gorges | 75/60 |
| 4,195,985 | 4/1980 | Brotzmann | 75/60 |
| 4,198,230 | 4/1980 | Brotzmann | 75/59 |
| 4,280,838 | 7/1981 | Marukawa | 75/60 |
| 4,302,244 | 11/1981 | Sieckman | 75/51 |
| 4,304,598 | 12/1981 | von Bogdandy | 75/60 |
| 4,329,171 | 5/1982 | Robert | 75/51 |

FOREIGN PATENT DOCUMENTS 2086431 9/1981 United Kingdom .

*Primary Examiner*—Peter D. Rosenberg
*Attorney, Agent, or Firm*—Bacon & Thomas

[57] ABSTRACT

The invention provides a process for the production of steel comprising the steps of providing a ferrous melt in a container, introducing iron ore into the container and separately introducing carbonaceous material into the melt, blowing an oxidizing gas at the upper surface of the melt by means of an overhead lance, and injecting a stirring gas directly into the melt below the upper surface thereof.

18 Claims, 2 Drawing Figures

PRODUCTION OF STEEL

Figure 1:
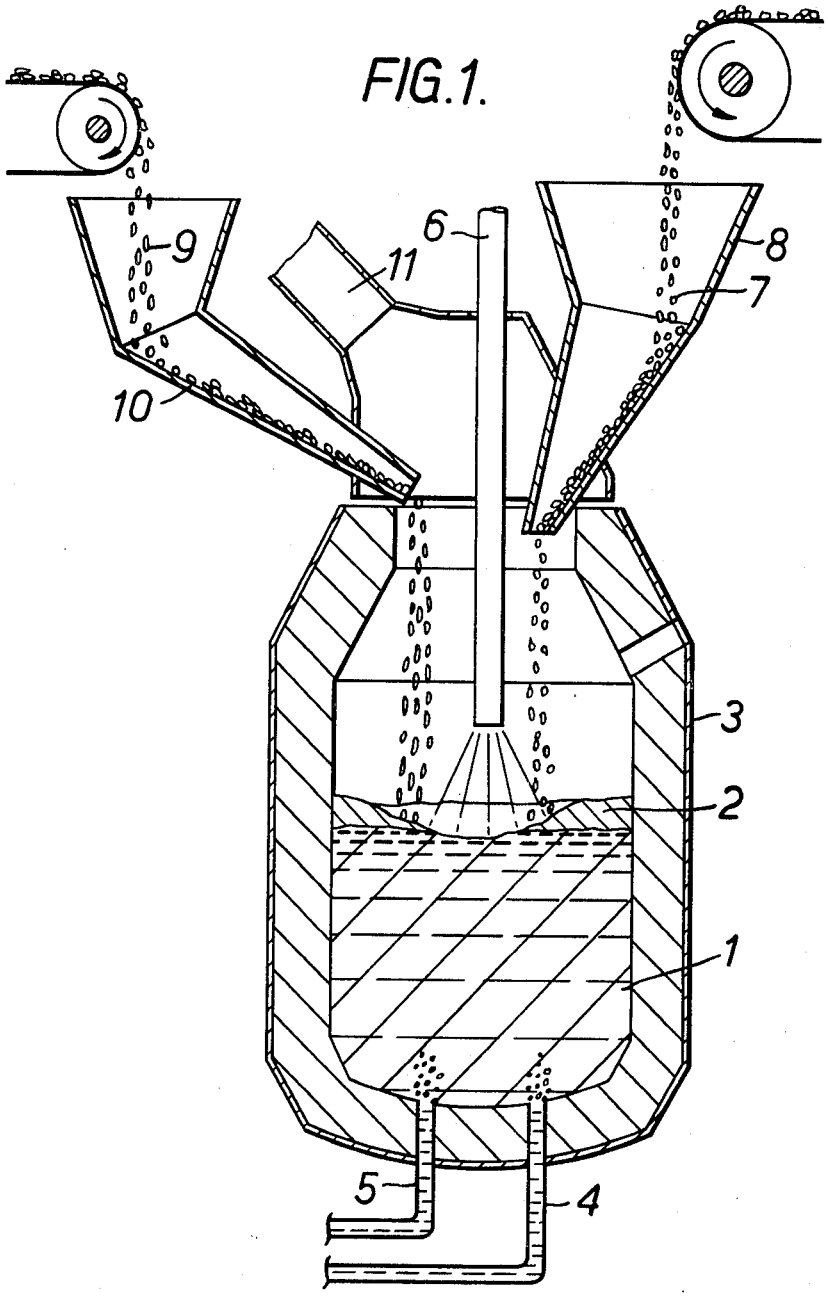

This invention relates to the production of steel, and more particularly to the production of steel in a direct route from iron ore.

According to the invention there is provided a process for the production of steel comprising the steps of providing a ferrous melt in a container, introducing iron ore into the container and separately introducing carbonaceous material into the melt, blowing an oxidising gas at the upper surface of the melt by means of an overhead lance, and injecting a stirring gas directly into the melt below the level of the upper surface thereof.

The invention as hereinabove defined may be carried out in a steel converter type vessel.

We have found that the invention enables the production of a steel melt direct from iron ore. In particular, we have found that the separate introduction of carbonaceous material together with oxygen blown on to the upper surface of the melt, and in association with the introduction of a stirring gas to encourage the transfer of heat and the reduction reaction, enables a most efficient steel producing operation to be carried out. The provision of the separate carbonaceous material especially aids the reduction chemistry and can provide a very rapid and convenient means for heat recovery.

The iron ore may be preheated and/or partially reduced before introduction to the container. Such preheating or partial reduction may be by means of the off-take gas from the container during processing.

The iron ore may be added individually or premixed with additional carbonaceous material and be in the form of a composite pellet or briquette.

The ore may be added by means of an additive chute or hopper.

Alternatively the ore may be blown on to or through the upper surface of the melt in granular or powder form entrained in a gas.

The overhead oxidising gas lance or a subsidiary lance may be used for transportation of the ore with one of, or a mixture of, a variety of carrier gases such as air or carbon dioxide.

Alternatively again the ore may be injected through a lance or a tuyere projecting into the container either above or below the melt surface in powder or granular form, again using a carrier for transportion.

It is to be appreciated that considerable off-gas will be produced during the process herein defined and that such off-gas can be used as a fuel.

The carbonaceous material may be of any convenient known kind. Thus it may be introduced in granular, pellet, lump, briquette or similar form by means of a chute or a hopper of the kind normally used for additives to a metallurgical vessel. Thus coke or coal may be introduced from such a hopper.

Alternatively the carbonaceous material may be blown on to or through the upper surface of the melt in granular or powder form entrained in a gas.

The overhead oxidising gas lance or a subsidiary lance may be used for transportation of the carbonaceous material with one of, or a mixture of, a variety of carrier gases such as air or carbon dioxide.

Alternatively again the carbonaceous material may be injected into the melt below the surface level thereof through a lance or a tuyere projecting into the container either above or below the melt surface in powder or granular form, again using a carrier gas for transportation.

The containing vessel may be rotated in operation to assist heat transfer.

The process according to the invention may be carried out on a batch basis, in which case it will be necessary to retain a quantity of melt within the container after discharging the majority of molten steel produced, so as to form an initial melt for the next production batch.

Alternatively the process according to the invention can be carried out on a continuous basis, in which case the containing vessel will be provided with an outlet for the continuous or periodic tapping of the vessel.

The resultant metal from the process according to the invention will be removed for refining or final converting in a separate vessel, although in some instances it may be desirable to carry out full refining in the containing vessel either as a continuous process utilising a launder type of arrangement or on a batch basis by interrupting the feeding of ore to the vessel so as to carry out refining.

The stirring gas may be introduced by tuyere, porous plugs, or permeable elements for example.

The stirring gas may comprise oxygen, carbon dioxide, hydrocarbon, steam, air, nitrogen, argon or other inert gases, or mixtures thereof. It is to be appreciated that whilst oxygen or an oxygen containing gas may be incorporated in the stirring gas, the major portion of the reaction oxygen will be provided by the overhead lance.

Figure 2:
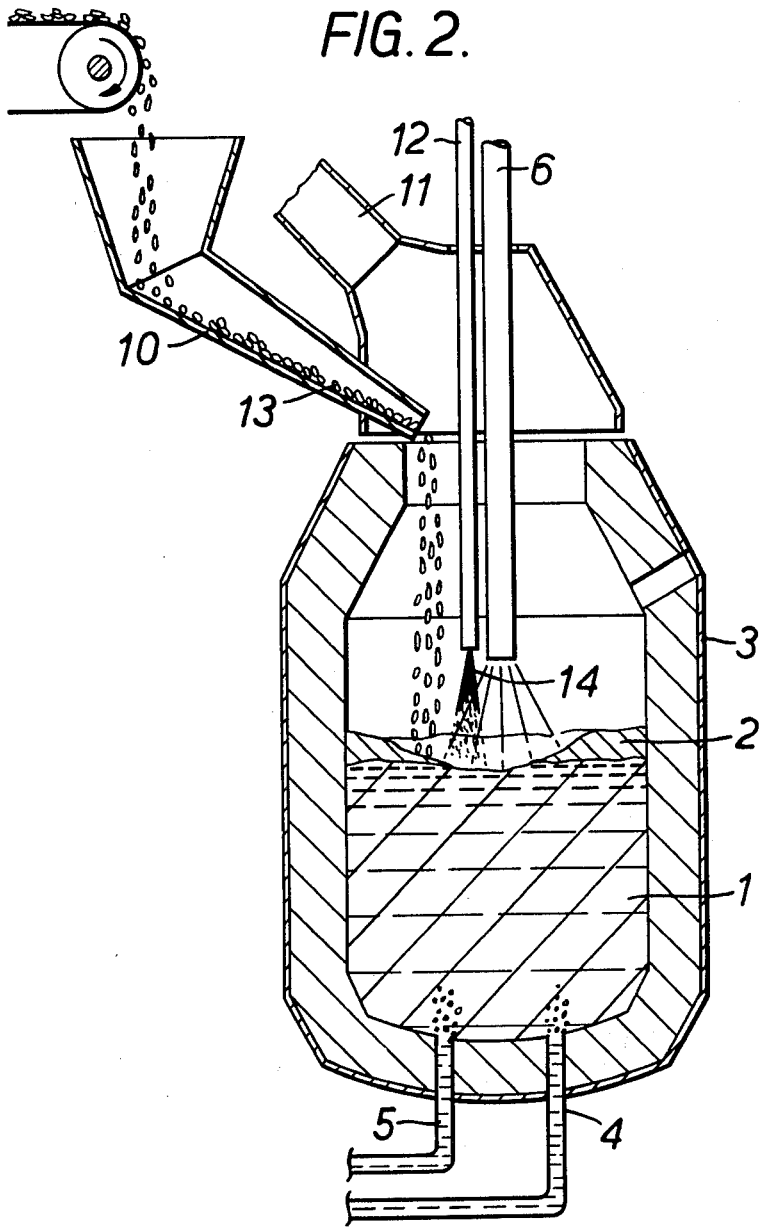

In order that the invention may be more readily understood, two embodiments thereof will now be described by way of example with reference to the accompanying drawings, in which :

FIG. 1 is a schematic elevation of one form of vessel adapted to carry out the present invention; and FIG. 2 is a schematic elevation of a second form of vessel adapted to carry out the present invention.

Referring now to FIG. 1, it will be seen that a ferrous melt 1 with an overlying slag layer 2 is located within a refractory-lined container vessel 3 of configuration generally similar to that of a LD steel refining vessel.

Tuyeres 4 and 5 are located in the base of the vessel, through which stirring gases are injected. An overhead lance 6 projects into the vessel and is arranged to blow oxygen on to the upper surface of the melt.

Coal granules 7 are fed to the melt via a hopper system 8. Preheated ferrous ore 9 in lump form is fed to the melt via a hopper system 10. An outlet conduit 11 is provided for the reducing gas produced in operation of the process. In operation a stirring gas comprising a hydro-carbon and oxygen mixture, is added through tuyeres 4 and 5.

Coal and ore falling upon and entering the melt react with the injected oxygen within the strongly stirred and agitated melt so as to cause reduction of the ore and the production of slag. Heat is produced from the oxidation of the coal to carbon monoxide, and further heat can be recovered from combustion of carbon monoxide to carbon dioxide. The heat so produced enables the ore reduction process to be sustained.

The reducing off gas produced can be used for the preheating and partial reduction of the incoming ore.

From time to time the vessel will be tilted for the removal of slag, and for the removal of the majority of the steel melt.

The arrangement of FIG. 2 is similar to FIG. 1 except that in this case coal in fine particulate form 14 is injected, using a carrier gas, by means of a lance 12.

A further difference from the arrangement of FIG. 1 is that ferrous ore is preformed into composite pellets 13 with additional coal before being fed to the melt via hopper system 10.

We claim:

1. A process for the production of steel, the steps of providing a ferrous melt in a container, introducing iron ore into the container and separately introducing carbonaceous material into the melt, blowing an oxidising gas at the upper surface of the melt by means of an overhead lance, and injecting a stirring gas directly into the melt below the upper surface thereof.

2. A process as claimed in claim 1 wherein it is carried out in a steel convertor type vessel.

3. A process as claimed in claim 1 wherein the carbonaceous material is introduced by means of a chute or a hopper.

4. A process as claimed in claim 3 wherein the carbonaceous material is in granular, pellet, lump or briquette form.

5. A process as claimed in claim 1 wherein the carbonaceous material is blown on to or through the upper surface of the melt entrained in a carrier gas.

6. A process as claimed in claim 5 wherein the carbonaceous material is blown by means of the overhead oxidising gas lance or a subsidiary lance.

7. A process as claimed in claim 1 wherein the carbonaceous material is injected into the melt, entrained in a gas below the surface level thereof by means of a lance or tuyere projecting into the container.

8. A process as claimed in claim 5 wherein the carbonaceous material is a coke or a coal.

9. A process as claimed in claim 1 wherein the iron ore is introduced by means of a chute or a hopper.

10. A process as claimed in claim 9 wherein the ore is in granular, pellet, lump or briquette form.

11. A process as claimed in claim 10 wherein the ore is premixed with additional carbonaceous material and is in the form of a composite pellet or briquette.

12. A process as claimed in claim 1 wherein the ore is blown on to or through the upper surface of the melt entrained in a carrier gas.

13. A process as claimed in claim 12 wherein the ore is blown by means of the overhead oxidising gas lance or a subsidiary lance.

14. A process as claimed in claim 1 wherein the ore is injected into the melt, entrained in a gas, below the surface level thereof by means of a lance or tuyere projecting into the container.

15. A process as claimed in claim 1 wherein the containing vessel is turned in operation to assist heat transfer.

16. A process as claimed in claim 1 wherein operation is carried out on a batch basis and in which some molten metal is retained in the containing vessel between batches.

17. A process as claimed in claim 1 wherein operation is carried out on a continuous basis, the containing vessel being subjected to periodic topping.

18. A process as claimed in claim 1 wherein the stirring gas is introduced by means of a tuyere, a porous plug, or a gas permeable element.

* * * * *